US007396214B2

(12) United States Patent
Hunter et al.

(10) Patent No.: US 7,396,214 B2
(45) Date of Patent: Jul. 8, 2008

(54) VARIABLE DISPLACEMENT PUMP AND CONTROL THEREFOR

(75) Inventors: Douglas G. Hunter, Troy, MI (US); Dennis Koenig, Hartland, MI (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 11/349,705

(22) Filed: Feb. 8, 2006

(65) Prior Publication Data

US 2006/0127229 A1 Jun. 15, 2006

Related U.S. Application Data

(62) Division of application No. 10/406,575, filed on Apr. 3, 2003, now Pat. No. 7,018,178.

(60) Provisional application No. 60/369,829, filed on Apr. 3, 2002.

(51) Int. Cl.
*F04C 14/18* (2006.01)

(52) U.S. Cl. ..... 417/213; 417/220

(58) Field of Classification Search ..... 123/196 R; 184/6.5; 417/212, 213, 219, 220; 418/26, 418/27, 30, 31
See application file for complete search history.

(56) References Cited

U.S. PATENT DOCUMENTS

| | | | | |
|---|---|---|---|---|
| 2,716,946 | A | 9/1955 | Hardy | |
| 2,799,995 | A | 7/1957 | Herman | |
| 3,011,308 | A | 12/1961 | Wotring | |
| 3,204,859 | A | 9/1965 | Crooks | |
| 3,771,921 | A | 11/1973 | Rohde et al. | |
| 3,918,855 | A | 11/1975 | Bornholdt | |
| 3,924,970 | A * | 12/1975 | Johnston et al. | 417/220 |
| 3,973,881 | A | 8/1976 | Melchinger | |
| 4,014,305 | A | 3/1977 | Skinner | |
| 4,035,105 | A | 7/1977 | Dantlgraber | |
| 4,222,718 | A | 9/1980 | Lemke | |
| 4,236,595 | A | 12/1980 | Beck et al. | |
| 4,259,039 | A | 3/1981 | Arnold | |
| 4,292,805 | A | 10/1981 | Acheson | |
| 4,325,215 | A | 4/1982 | Yamamoto | |
| 4,328,480 | A | 5/1982 | Keitel et al. | |
| 4,348,159 | A | 9/1982 | Acheson | |
| 4,369,743 | A | 1/1983 | Holt et al. | |
| 4,433,648 | A * | 2/1984 | LeBlanc | 123/41.12 |
| 4,450,818 | A | 5/1984 | Thoma et al. | |
| 4,468,173 | A | 8/1984 | Dantlgraber | |
| 4,496,288 | A | 1/1985 | Nakamura et al. | |
| 4,510,962 | A | 4/1985 | Mott et al. | |
| 4,531,706 | A | 7/1985 | Weiger et al. | |
| 4,531,898 | A | 7/1985 | Ideta | |
| 4,538,974 | A | 9/1985 | Stich et al. | |

(Continued)

FOREIGN PATENT DOCUMENTS

| | | |
|---|---|---|
| CA | 2 385 897 | 11/2003 |

(Continued)

*Primary Examiner*—Michael Koczo, Jr.
(74) *Attorney, Agent, or Firm*—Warn Partners, P.C.

(57) ABSTRACT

A control system for a variable displacement pump. The control system is operably associated with an engine control unit for passively or actively controlling the output of the pump in response to signals from the engine control unit.

2 Claims, 9 Drawing Sheets

U.S. PATENT DOCUMENTS

| | | | | |
|---|---|---|---|---|
| 4,606,313 | A | | 8/1986 | Izumi et al. |
| 4,632,638 | A | | 12/1986 | Shibayama et al. |
| 4,693,081 | A | | 9/1987 | Nakamura et al. |
| 4,710,106 | A | | 12/1987 | Iwata et al. |
| 4,711,616 | A | | 12/1987 | Tsukahara et al. |
| 4,738,330 | A | | 4/1988 | Suzuki et al. |
| 4,740,142 | A | | 4/1988 | Rohs et al. |
| 4,754,738 | A | | 7/1988 | Grohn et al. |
| 4,774,918 | A | | 10/1988 | Kurio et al. |
| 4,803,969 | A | | 2/1989 | Hiereth et al. |
| 4,825,692 | A | | 5/1989 | Rohs et al. |
| 4,850,269 | A | | 7/1989 | Hancock et al. |
| 4,905,807 | A | | 3/1990 | Rohs et al. |
| 4,974,562 | A | | 12/1990 | Ishii et al. |
| 4,976,230 | A | | 12/1990 | Voigt |
| 5,017,098 | A | | 5/1991 | Hansen et al. |
| 5,052,896 | A | | 10/1991 | Fischer et al. |
| 5,063,895 | A | | 11/1991 | Ampferer |
| 5,067,454 | A | | 11/1991 | Waddington et al. |
| 5,078,233 | A | | 1/1992 | Oetting et al. |
| 5,085,187 | A | | 2/1992 | Black |
| 5,090,881 | A | | 2/1992 | Suzuki et al. |
| 5,101,789 | A | | 4/1992 | Voigt et al. |
| 5,105,679 | A | | 4/1992 | Voigt |
| 5,141,418 | A | | 8/1992 | Ohtaki et al. |
| 5,190,003 | A | | 3/1993 | Voigt |
| 5,195,474 | A | | 3/1993 | Urata et al. |
| 5,197,860 | A | | 3/1993 | Nishida et al. |
| 5,239,885 | A | | 8/1993 | Voigt |
| 5,273,020 | A | | 12/1993 | Hayami |
| 5,303,551 | A | | 4/1994 | Lee |
| 5,315,971 | A | | 5/1994 | Yamada |
| 5,339,776 | A | | 8/1994 | Regueiro |
| 5,353,753 | A | | 10/1994 | McGrath et al. |
| 5,355,851 | A | | 10/1994 | Kamiya |
| 5,390,635 | A | | 2/1995 | Kidera et al. |
| 5,398,505 | A | | 3/1995 | Oogushi et al. |
| 5,404,855 | A | | 4/1995 | Yen et al. |
| 5,435,698 | A | | 7/1995 | Phillips |
| 5,465,699 | A | | 11/1995 | Voigt |
| 5,467,843 | A | | 11/1995 | Esch et al. |
| 5,484,271 | A | | 1/1996 | Stich |
| 5,485,725 | A | | 1/1996 | Teraoka |
| 5,490,770 | A | | 2/1996 | Oogushi |
| 5,527,156 | A | | 6/1996 | Song |
| 5,544,628 | A | | 8/1996 | Voigt |
| 5,545,014 | A | | 8/1996 | Sundberg et al. |
| 5,545,018 | A | | 8/1996 | Sundberg |
| 5,588,504 | A | | 12/1996 | Spiegel et al. |
| 5,618,165 | A | | 4/1997 | Larsson et al. |
| 5,630,383 | A | | 5/1997 | Kidera et al. |
| 5,690,479 | A | | 11/1997 | Lehmann et al. |
| 5,752,815 | A | | 5/1998 | Müller |
| 5,797,732 | A | | 8/1998 | Watanabe et al. |
| 5,800,130 | A | * | 9/1998 | Blass et al. ..... 417/213 |
| 5,800,131 | A | | 9/1998 | Lehmann et al. |
| 5,826,556 | A | | 10/1998 | Ruman et al. |
| 5,863,189 | A | | 1/1999 | Sundberg et al. |
| 5,904,126 | A | | 5/1999 | McKay et al. |
| 5,918,573 | A | | 7/1999 | Killion |
| 5,921,758 | A | | 7/1999 | Anamoto et al. |
| 5,947,695 | A | | 9/1999 | Nagaoka et al. |
| 5,996,541 | A | | 12/1999 | Voigt et al. |
| 6,053,137 | A | | 4/2000 | Trzmiel et al. |
| 6,065,433 | A | | 5/2000 | Hill |
| 6,079,380 | A | | 6/2000 | Jorgensen et al. |
| 6,131,539 | A | | 10/2000 | Thomas |
| 6,155,797 | A | | 12/2000 | Kazuyoshi |
| 6,179,570 | B1 | * | 1/2001 | Smith ..... 417/212 |
| 6,183,210 | B1 | | 2/2001 | Nakamura |
| 6,202,016 | B1 | | 3/2001 | Stephenson et al. |
| 6,216,651 | B1 | | 4/2001 | Ishikawa et al. |
| 6,408,975 | B1 | | 6/2002 | Bishop et al. |
| 6,413,054 | B1 | | 7/2002 | Geiger et al. |
| 6,488,479 | B1 | | 12/2002 | Berger |
| 6,524,076 | B2 | | 2/2003 | Konishi |
| 6,530,752 | B2 | | 3/2003 | Oba et al. |
| 6,615,683 | B1 | | 9/2003 | Voigt |
| 6,669,439 | B2 | | 12/2003 | Kardasz et al. |
| 6,684,636 | B2 | * | 2/2004 | Smith ..... 417/212 |
| 6,790,013 | B2 | | 9/2004 | Hunter et al. |
| 6,896,489 | B2 | | 5/2005 | Hunter et al. |
| 2001/0036412 | A1 | | 11/2001 | Konishi |
| 2005/0118033 | A1 | | 6/2005 | Schneider |

FOREIGN PATENT DOCUMENTS

| | | |
|---|---|---|
| DE | 32 30 432 | 2/1984 |
| DE | 32 38 650 | 4/1984 |
| DE | 34 46 603 | 7/1985 |
| DE | 36 21 720 | 1/1987 |
| DE | 37 11 792 | 10/1987 |
| DE | 37 29 545 | 3/1988 |
| DE | 37 42 315 | 7/1988 |
| DE | 38 24 398 | 2/1989 |
| DE | 38 40 909 | 6/1989 |
| DE | 39 25 249 | 3/1990 |
| DE | 43 02 610 | 1/1993 |
| DE | 42 42 871 | 6/1994 |
| DE | 44 44 819 | 6/1996 |
| DE | 101 41 786 | 3/2003 |
| DE | 101 44 693 | 3/2003 |
| DE | 40 38 549 | 7/2003 |
| DE | 102 37 801 | 7/2003 |
| EP | 1 076 164 | 2/2001 |
| EP | 1 130 262 | 9/2001 |
| EP | 1 316 683 | 6/2003 |
| EP | 1 350 930 | 10/2003 |
| FR | 2 597 546 | 10/1987 |
| FR | 2 673 676 | 9/1992 |
| JP | 62 294 790 | 12/1987 |
| JP | 80 14 164 | 1/1996 |
| JP | 2001 159395 | 6/2001 |
| JP | 2001 173575 | 6/2001 |
| JP | 2001 294166 | 10/2001 |
| WO | WO 01/55597 | 8/2001 |
| WO | WO 01/79703 | 10/2001 |
| WO | WO 03/058071 | 7/2003 |

* cited by examiner

VARIABLE DISPLACEMENT PUMP AND CONTROL THEREFOR

CROSS-REFERENCE TO RELATED APPLICATIONS

The instant application is a divisional of U.S. patent application Ser. No. 10/406,575, filed Apr. 3, 2003, and claims priority to U.S. Provisional Application No. 60/369,829, filed Apr. 3, 2002, the entire specifications of both of which are expressly incorporated herein by reference.

FIELD OF THE INVENTION

The present invention relates to the control of the output of a variable displacement pump. More specifically, the present invention relates to control of an oil pump for oil pressure control in an internal combustion engine, transmission or the like.

BACKGROUND OF THE INVENTION

It is desirable to properly lubricate the moving components in an internal combustion engine and provide hydraulic power. Typically, oil pumps used in engines are directly connected to the crankshaft of the engine. While this configuration is generally adequate, there are some disadvantages. First, there is not much control of the actual discharge pressure relative to the pressure needed by the engine under certain/given operating conditions. For instance, during start-up conditions it may be desirable to have higher initial pressure to get engine oil into the engine. At crucial start-up, this cannot be facilitated with the direct drive pumps. Additionally, with the pump shaft RPM directly tied to the engine RPM, in many areas over the RPM range the engine oil pressure is higher or lower than that which is desirable. This results in inefficient use of engine power and/or inefficient engine oil lubrication.

In commonly assigned co-pending application U.S. Ser. No. 10/021,566, a mechanical hydraulic arrangement is shown for providing control of a variable displacement vane pump. This provides for a more optimized control of engine oil pressure. However, it is yet desirable to provide some further control depending on engine needs or variables. Thus, in the present invention there is provided a method of control and system for control of a variable displacement vane pump by the use of an engine control unit which actuates a solenoid for directly or indirectly controlling the stroke of a variable displacement vane pump.

SUMMARY OF THE INVENTION

A control system for a hydraulic variable displacement vane-type pump wherein input from an engine control unit actuates a solenoid for controlling the engine oil pressure to the desired level under any operating conditions.

A further understanding of the present invention will be had in view of the description of the drawings and detailed description of the invention, when viewed in conjunction with the subjoined claims.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

In the present invention, a method of controlling a variable displacement pump 10 for an engine is provided. In a preferred embodiment of the invention that incorporates a solenoid 26, unless stated otherwise, it should be understood that the solenoid 26 is normally, or is defaulted to, the closed position when no power is supplied to the solenoid 26. When the solenoid 26 is in the closed position there will be high fluid displacement by the pump 10. Thus, in an emergency event, such as when there is an electrical failure, the solenoid 26 will move to its default position so the engine oil pressure will remain high and that the vehicle can continue operating until it can serviced. However, it is to be understood that with the solenoid in a closed position the system could also be configured so that there is fluid displacement with the pump 10.

Figure 1:
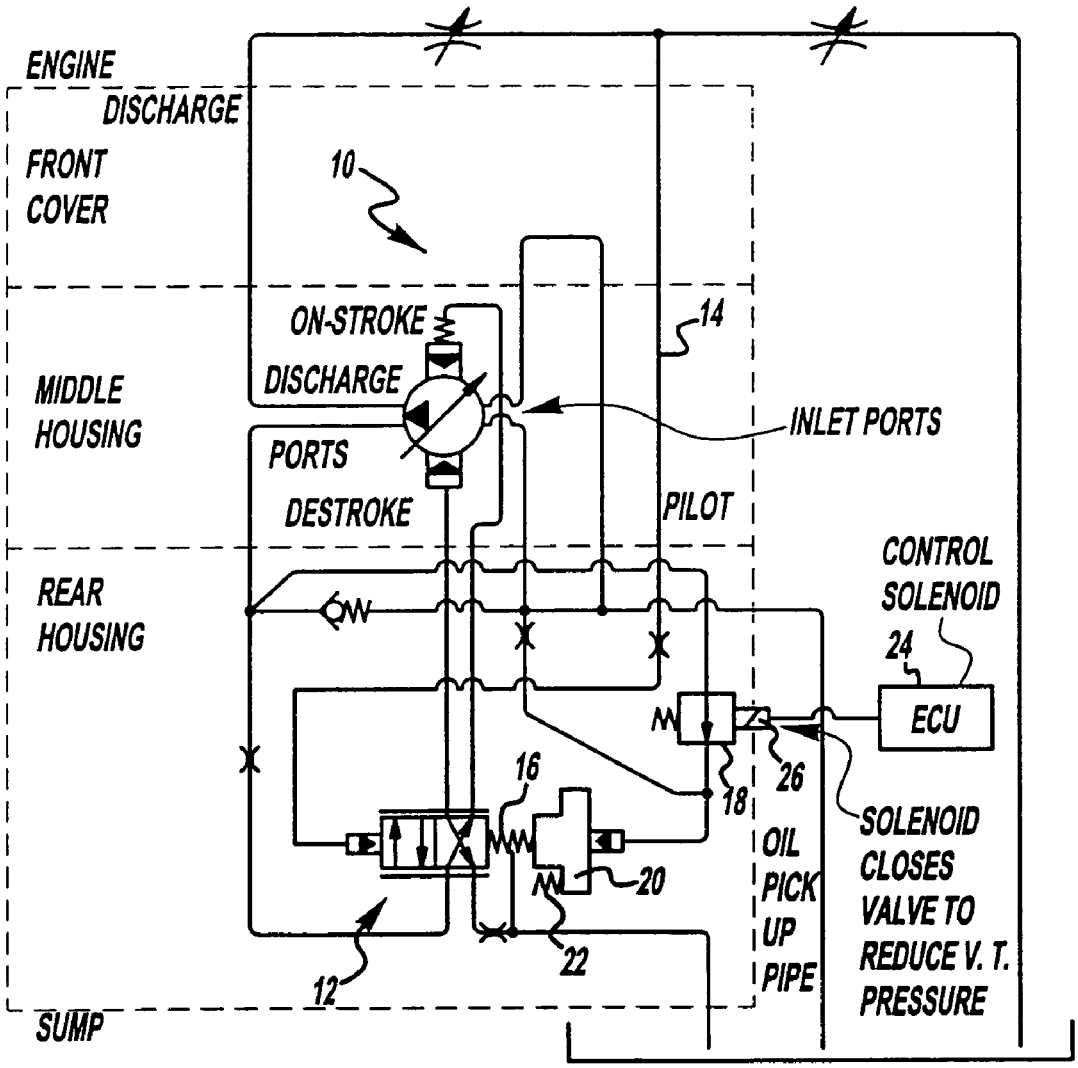
FIG. 1 is a hydraulic schematic showing a first embodiment of the present invention.

In accordance with FIG. 1, the pump is a vane-type variable displacement pump, as set forth in co-pending application Ser. No. 10/021,566, filed Dec. 12, 2000, the specification of which is incorporated by reference herein. Specifically, the pump is designed for an engine lubrication circuit. The pump is generally shown at 10. The pump 10 may be a vane pump which has the displacement varied by movement of an eccentric ring 11. It is also possible to incorporate other types of pumps, in which the stroke or displacement may be adjusted during operation.

A flow control valve 12 is used to mechanically vary the displacement of a pump 10, by moving the eccentric ring 11, based on an engine pilot pressure 14 acting on the flow control valve 12 which controls the volume of oil in each control chamber on each side of the eccentric ring 11. A compression spring 16 acts against a pilot pressure 14 for maintaining some pressure on the flow control valve 12 and to provide a return pressure in absence of the pilot pressure 14. The flow control valve 12 in this particular embodiment is a spool valve such as a three-way spool valve. However, it should be understood that the flow control valve 12 can be a spool valve of any type of configuration. Also, the flow control valve 12 does not necessarily need to be a spool valve at all, as will be seen in FIG. 6. The compression spring 16 gives the spool portion of the valve 12 travel distance that is proportional to the differential between the actual pressure of the system and the desired or target system pressure. The differential pressure is variable by way of a valve 18, which controls the amount of pressure acting on the variable target piston 20 against spring 22 for varying the amount of spring 16 pressure on valve 12. An engine control unit (ECU) 24 monitors the engine conditions and parameters such as temperature, speed and engine load. In this embodiment, the engine control unit 24 monitors the engine conditions pressure, speed, and engine load and then selects a desired oil pressure, and sends the appropriate current to the solenoid 26 acting on valve 18. This varies the pressure acting on the piston 20, changing its position and thereby reducing or increasing target pressure, depending upon the desired engine oil pressure target. The flow control valve 12 then regulates the pump's 10 eccentric ring 11 to maintain target pressure.

Figure 2:
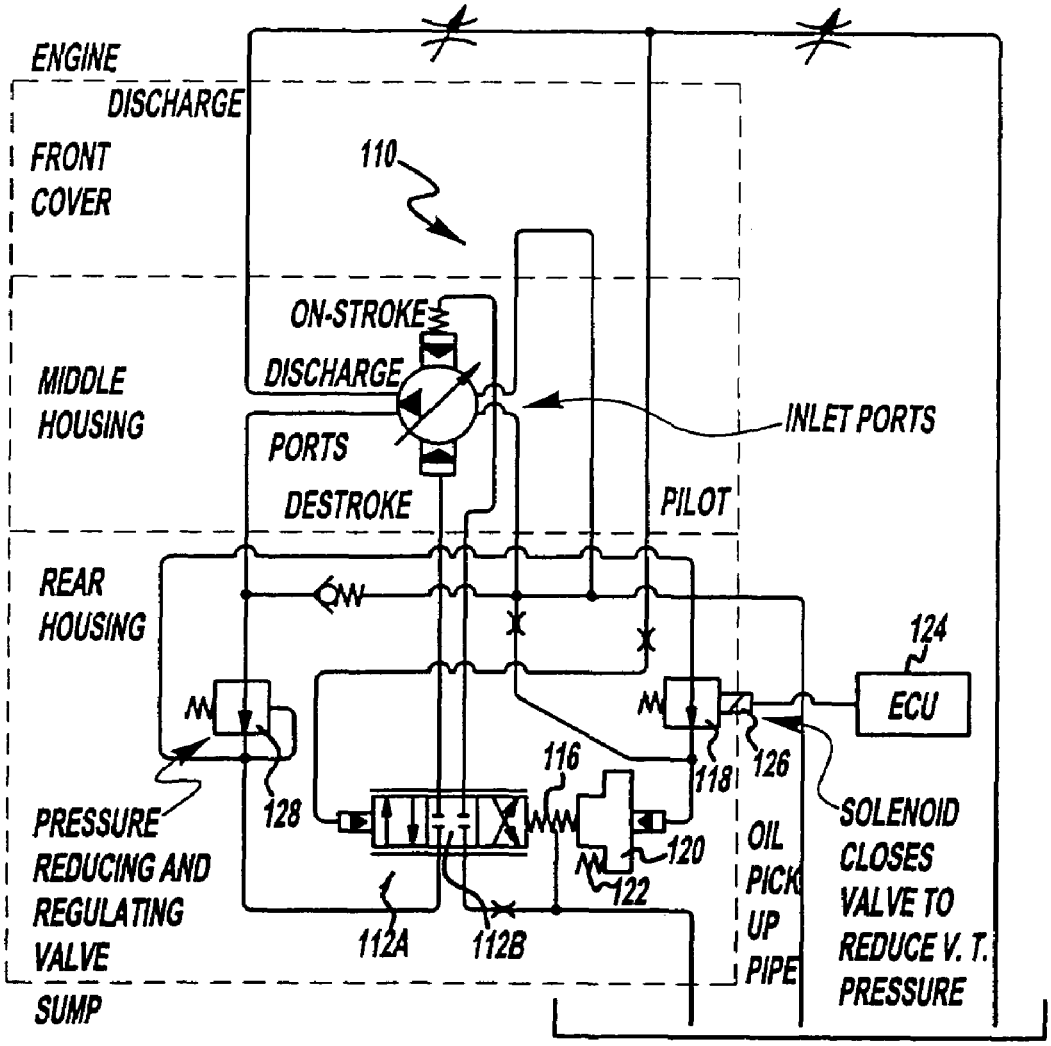
FIG. 2 is a hydraulic schematic showing a second embodiment of the present invention

With respect to FIG. 2, like items referenced in FIG. 1 are similarly designated with reference numerals differing by 100. The operation of this embodiment is similar to the embodiment shown in FIG. 1. The valve 112*a* includes a closed center valve portion 112*b*. However, the main operating difference is the use of a pressure reducing and regulating valve 128. The regulating valve 128 creates a fixed input pressure for the solenoid valve 118 in that the pressure, which in FIG. 1 was taken from the discharge port of the pump 10 into the solenoid control valve 18, is now at a constant pressure and, therefore, provides better control of the variable target pressure acting on piston 120. This ultimately provides improved control over the desired movement of the eccentric ring 111 of the pump 110.

Figure 2A:
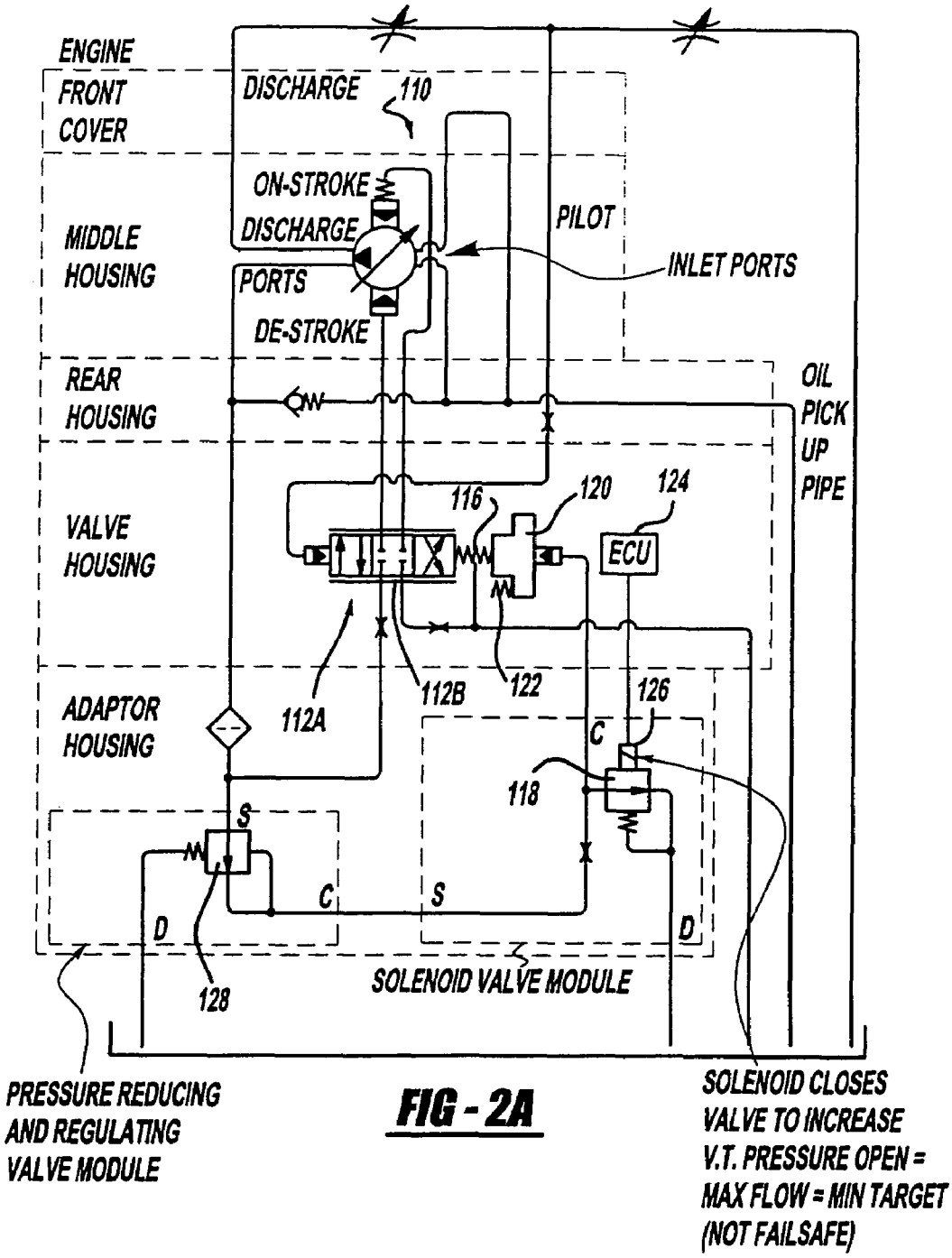
FIG. 2*a* is a variation of the second embodiment of the present invention.

FIG. 2*a* operates in a similar manner as FIG. 2. The main difference between FIG. 2 and FIG. 2*a* is that the pressure reducing and regulating valve 128 of FIG. 2*a* creates a fixed target pressure that acts directly on the piston 120. The solenoid 126 opens or closes to further adjust the pressure of fluid acting on the piston 120. When the solenoid 126 moves the valve 118*a* to the closed position there is an increase in variable target pressure. When the solenoid 126 moves the valve 118*a* to the open position the variable target pressure will decrease as the fluid moves to the sump with less resistance. Additionally, unreduced pressure is fed to the spool valve 112A before pressure the pressure reducing and regulating valve 128 after the filter. Just as in FIG. 2, this embodiment is also a passive system for controlling oil flow and oil pressure since an engine control unit 124 controls the solenoid 126 for positioning the piston 120, however, the engine control unit 124 does not directly sense oil pressure.

Figure 3:
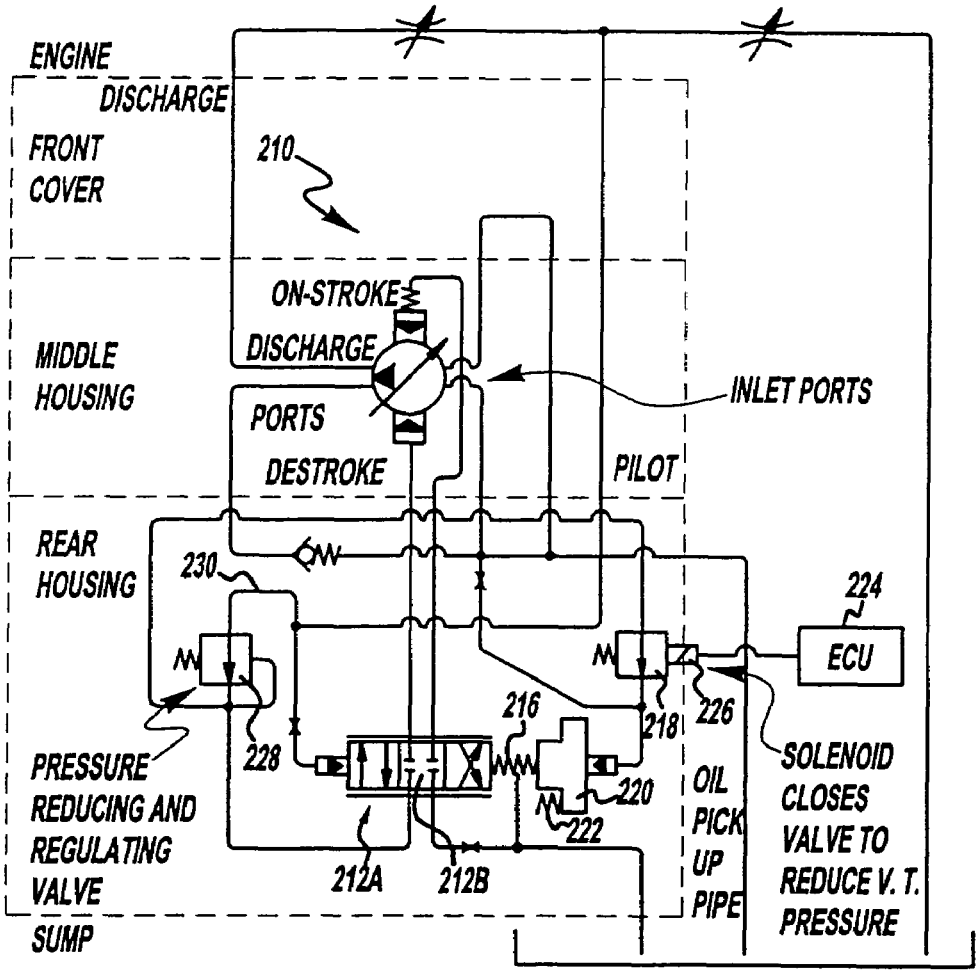
FIG. 3 is a hydraulic schematic showing a third embodiment of the present invention.

With respect to FIG. 3, like items referenced in FIG. 2 are similarly designated with reference numerals differing by 100. In FIG. 3, the source for the pressure which is regulated by the valve 218 is taken from the pilot line instead of the discharge line. Otherwise, the control operation is similar to that shown in FIGS. 1 and 2.

Figure 4:
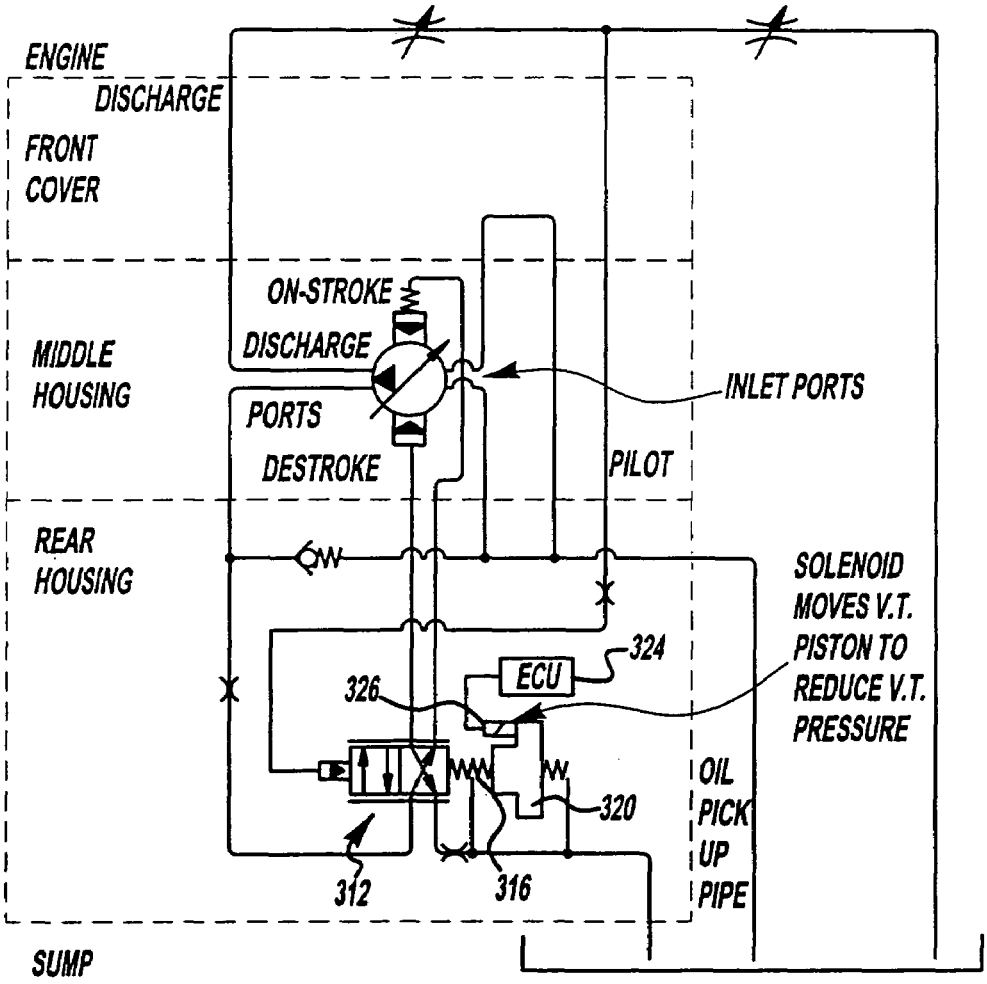
FIG. 4 is a hydraulic schematic showing a forth embodiment of the present invention.

With respect to FIG. 4, like items referenced in FIG. 3 are similarly designated with reference numerals differing by 100. In this particular embodiment the solenoid 326 directly controls the movement of the variable target piston 320. The engine control unit 324 is connected to the solenoid 326 and controls the actuation of the solenoid. The configuration of this embodiment (i.e., the solenoid acting directly on the variable target piston 320) allows the variable target piston to be adjusted in accordance with the engine control unit's 324 commands directly, rather than using additional hydraulics.

Figure 5:
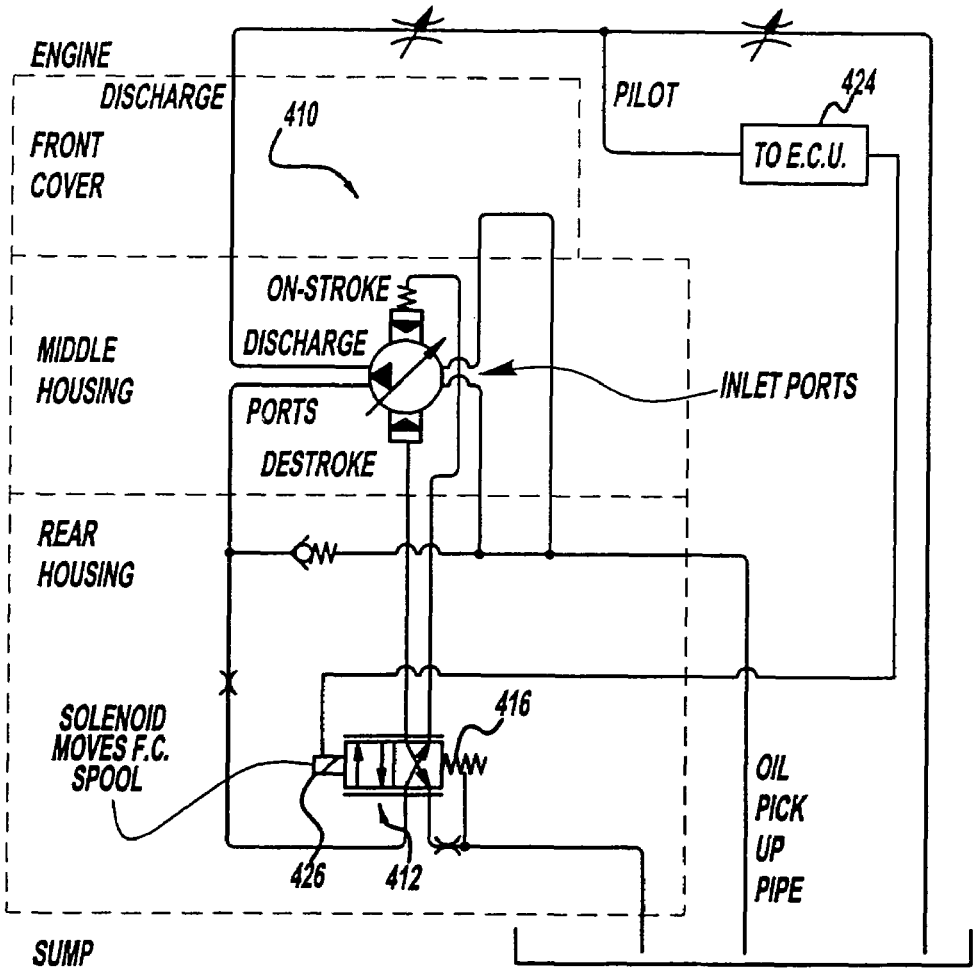
FIG. 5 is a hydraulic schematic showing a fifth embodiment of the present invention.

With respect to FIG. 5, like items referenced in FIG. 4 are similarly designated with reference numerals differing by 100. With respect to FIG. 5, this embodiment includes a solenoid 426 attached to the flow control spool valve 412 directly, to regulate the stroke or de-stroke conditions of the pump 410. The solenoid 426 is connected directly to the engine control unit 424. The engine control unit 424 samples the pilot pressure from a pressure transducer in the engine circuit in order to make the proper calculations as to the best spool position based on the current actual and target pressures. Return spring 416 provides the return pressure for adjusting the flow control spool valve 412 in absence of solenoid 426 input, and allows for predetermined functions of spool position versus current.

Figure 6:
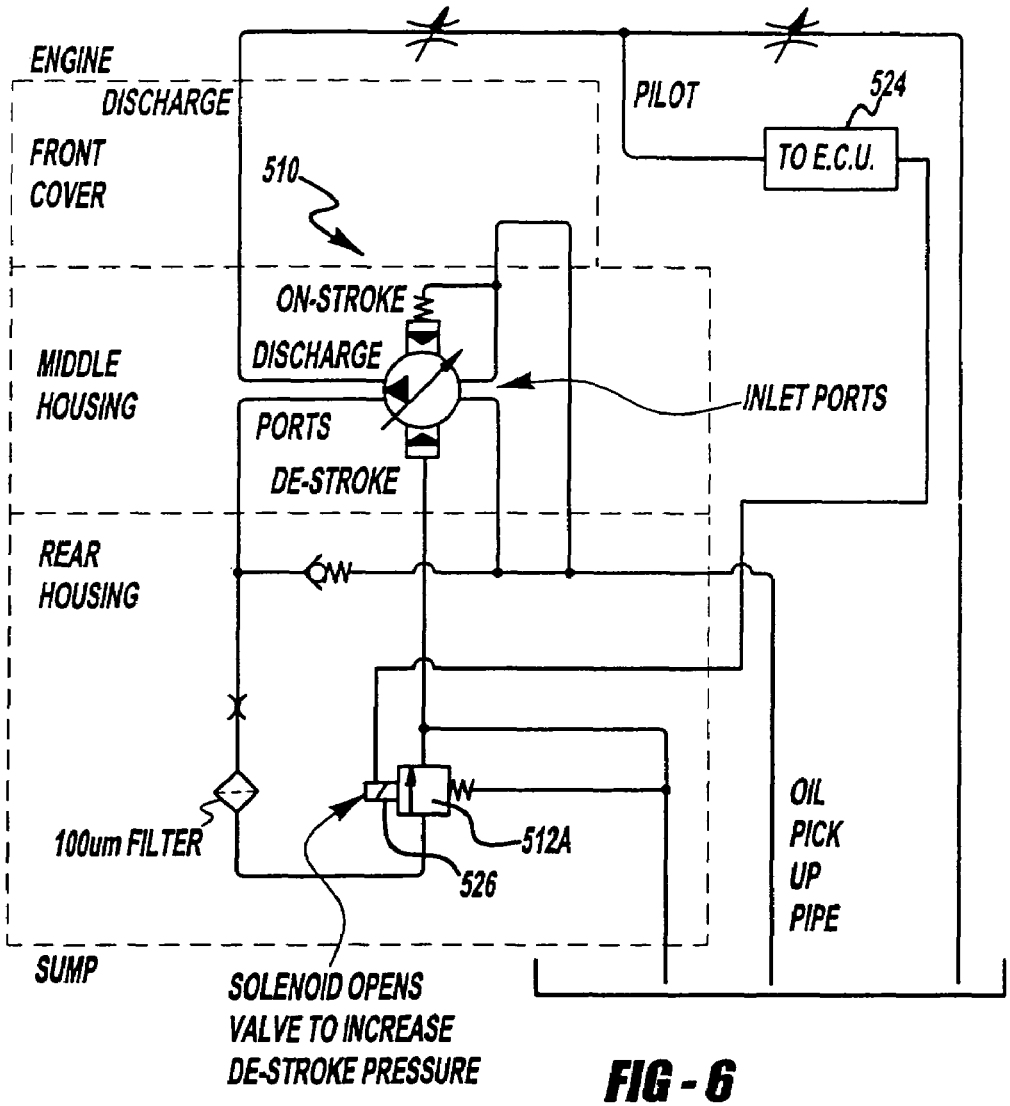
FIG. 6 is a hydraulic schematic showing a sixth embodiment of the present invention.

With respect to FIG. 6, like items referenced in FIG. 5 are similarly designated with reference numerals differing by 100. With respect to FIG. 6, a very simple control mechanism is used by the control solenoid 526 moving a valve 512A for controlling the de-stroke actuator of the pump 510. The solenoid 526 adjusts the pressure acting on the large piston which pushes against the discharge pressure acting on the small piston on the opposite side. An on-stroke return spring is provided for balancing the eccentric control ring against control inputs which can also work alone (as shown). In this embodiment, the engine control unit 524 samples the pilot pressure from a pressure transducer in the engine circuit in order to make the proper calculations as to the best valve 512A position.

Figure 7:
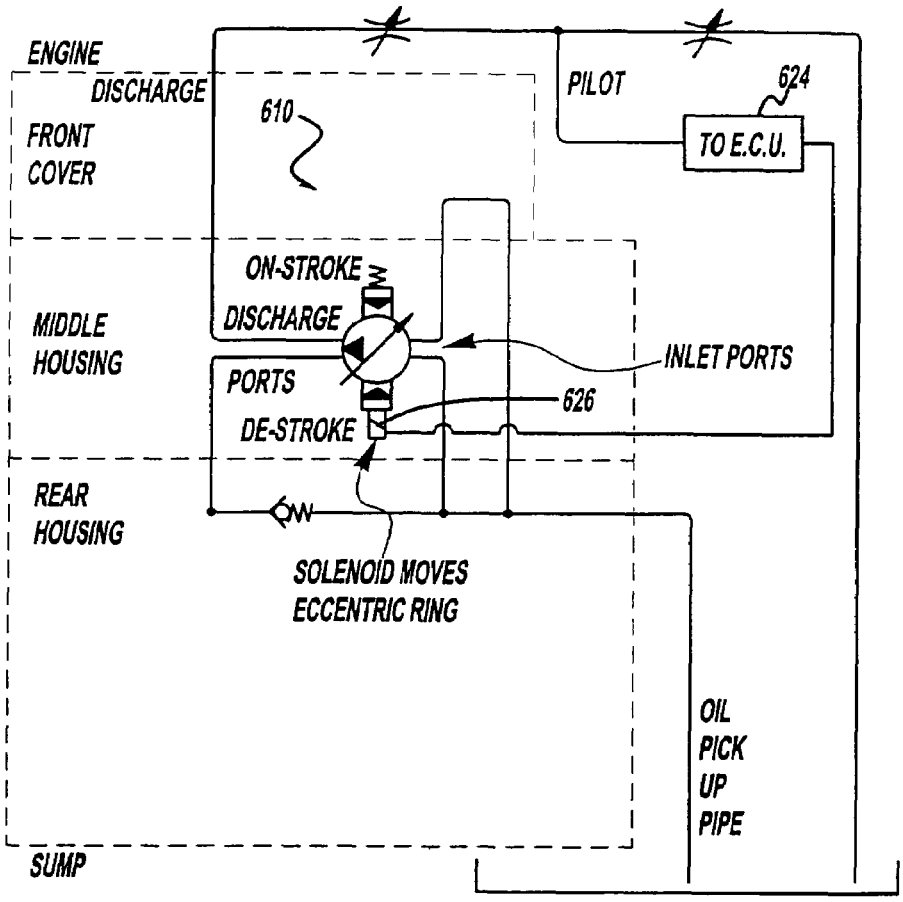
FIG. 7 is a hydraulic schematic showing a seventh embodiment of the present invention.

With respect to FIG. 7, like items referenced in FIG. 6 are similarly designated with reference numerals differing by 100. FIG. 7 is another embodiment wherein engine control unit 624 directly controls a solenoid 626 which acts directly on either the actuating piston for the eccentric ring or directly on the eccentric ring. This allows direct control of the displacement of the pump 610 based on ECU 624 monitoring of the pilot pressure of the oil pressure circuit.

Figure 8:
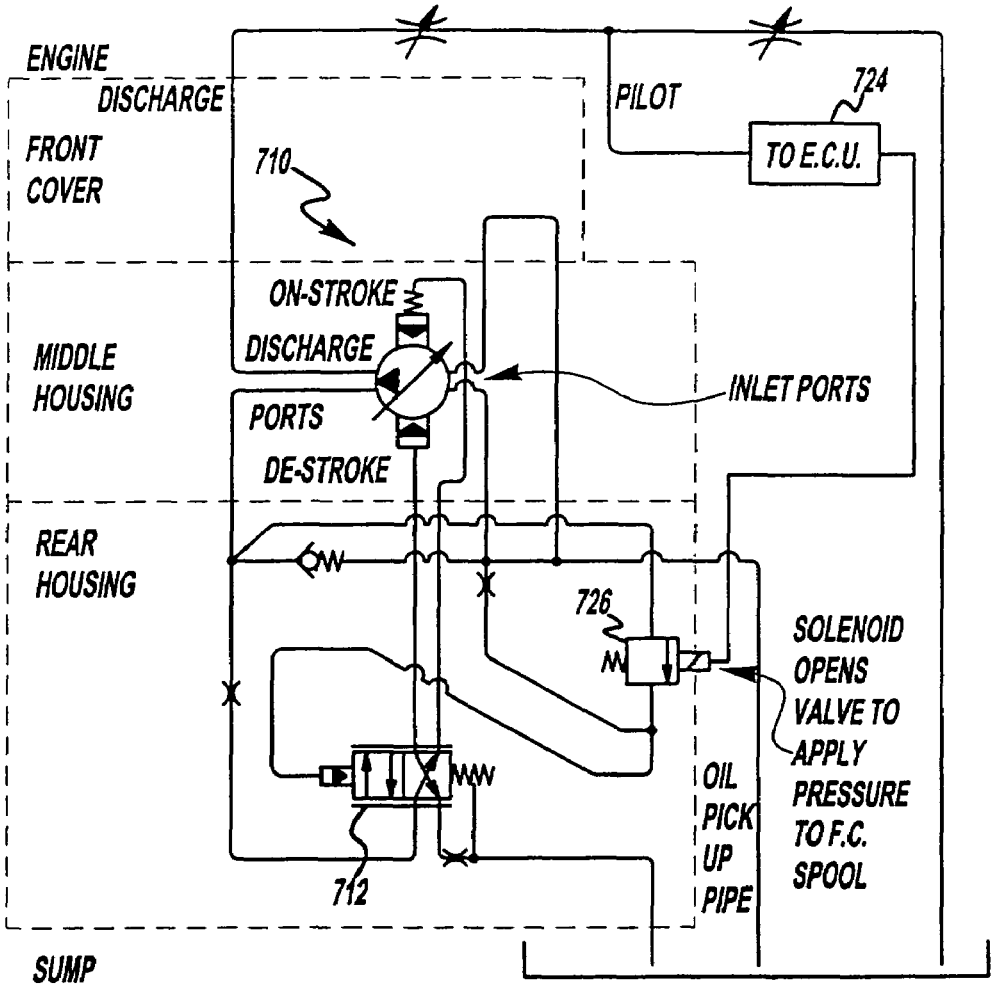
FIG. 8 is a hydraulic schematic showing an eighth embodiment of the present invention.

FIG. 8 illustrates a further embodiment wherein the solenoid 726 directly actuates the spool flow control valve 712. Again, the ECU 724 is monitoring the engine oil circuit pressure and adjusting the solenoid in accordance with the necessary engine oil pressure, as calculated by the ECU. In this embodiment, pressure from the discharge is reduced by the solenoid valve and used to bias the position of the flow control spool valve 712 against the spring for varying the displacement of the pump. Flow across the solenoid can be directed to the inlet port, as shown of the vane pump 710, but can also be drained to the sump.

As can be seen by the drawings, the methods shown in FIGS. 1 through 4 are passive systems which allow the ECU to monitor engine conditions and provide a pressure target to the pump system, but the pump system is self-regulated to the pressure target by mechanical and hydraulic controls. FIGS. 5 through 8 provide active control of the oil pressure by the ECU. In these embodiments, the ECU monitors the oil pressure and actively adjusts the system on a real time basis to control oil pressure in the engine.

Those skilled in the art can now appreciate from the foregoing description that the broad teachings of the present invention can be implemented in a variety of forms. Therefore, while this invention has been described in connection with particular examples thereof, the true scope of the invention should not be so limited, since other modifications will become apparent to the skilled practitioner upon a study of the drawings, specification and following claims.

The description of the invention is merely exemplary in nature and, thus, variations that do not depart from the scope of the invention are intended to be within the scope of the invention. Such variations are not to be regarded as a departure from the spirit and scope of the invention.

What is claimed is:

1. A variable displacement pump for an engine having an engine control unit comprising:

a pump having an actuator that controls the pressure and flow of oil to a pressure lubricating circuit of an engine;

a pilot pressure line that has oil flow and oil pressure supplied by the engine;

a flow control valve for hydraulically varying the pump displacement by facilitating movement of said actuator; and a solenoid controlled by said engine control unit, said solenoid is connected to the flow control valve and controls the position of said flow control valve and provides control of oil flow through said flow control valve.

2. The control system of claim 1, wherein the valve member is connected to a sump, so that when the solenoid opens the valve member, an input pressure to the actuating member increases.

* * * * *